US006187136B1

(12) United States Patent
Pedersen et al.

(10) Patent No.: US 6,187,136 B1
(45) Date of Patent: Feb. 13, 2001

(54) PROCESS FOR INCREASING THE CHARGE ON A LIGNOCELLULOSIC MATERIAL

(75) Inventors: Lars Saaby Pedersen, Farum; Claus Felby, Herlev; Niels Munk, Frederiksberg, all of (DK)

(73) Assignee: Novo Nordisk A/S, Bagsvaerd (DK)

( * ) Notice: Under 35 U.S.C. 154(b), the term of this patent shall be extended for 0 days.

(21) Appl. No.: 09/118,409

(22) Filed: Jul. 17, 1998

Related U.S. Application Data

(63) Continuation of application No. PCT/DK97/00052, filed on Feb. 7, 1997.

(30) Foreign Application Priority Data

Feb. 8, 1996 (DK) ..... 0127/96

(51) Int. Cl.[7] ..... D21C 9/147; D21C 9/16; D21H 25/02

(52) U.S. Cl. ..... 162/65; 162/72; 162/76; 162/78; 162/95; 162/96; 162/98; 435/277; 435/278; 435/279

(58) Field of Search ..... 435/277, 278, 435/279; 162/72, 76, 95, 98, 96, 78, 65

(56) References Cited

U.S. PATENT DOCUMENTS

| | | | | |
|---|---|---|---|---|
| 4,432,921 | | 2/1984 | Haars et al. | 264/109 |
| 5,203,964 | * | 4/1993 | Call | 162/72 |

FOREIGN PATENT DOCUMENTS

| | | | | |
|---|---|---|---|---|
| 0 429 422 | * | 5/1991 | (EP) | 162/72 |
| 0 433 258 A1 | | 6/1991 | (EP) . | |
| 0 565 109 A1 | | 10/1993 | (EP) . | |
| WO 88/03190 | | 5/1988 | (WO) . | |
| WO 92/20857 | | 11/1992 | (WO) . | |
| WO 95/076 | | 3/1995 | (WO) . | |
| WO 96/03546 | | 2/1996 | (WO) . | |

OTHER PUBLICATIONS

Philippou et al., "Applicability of Oxidative Systems To Initiate Grafting On and Bonding of Wood", 1981 by Marcel Dekker, Inc., pp. 199–221.

Smith et al., "Chemical Additives For Improved Compression Strength of Unbleached Board", 1992 Papermakers Conference, pp. 393–405.

* cited by examiner

*Primary Examiner*—Steve Alvo
(74) *Attorney, Agent, or Firm*—Elias J. Lambiris, Esq.; Reza Green, Esq.

(57) ABSTRACT

A process for production of a lignocellulosic material modified by conjugation thereto of a phenolic substance comprising a substituent which, in the conjugated form of the phenolic substance, is, or may become, negatively or positively charged, respectively, comprises: reacting a lignocellulosic fibre material and the phenolic substance with an oxidizing agent in the presence of an enzyme capable of catalyzing the oxidation of phenolic groups by the oxidizing agent; and reacting together the products of the reactions; with the proviso that the phenolic substance is not a phenolic polysaccharide. A strengthened lignocellulose-based product (e.g. a paper product) may be prepared by a procedure wherein a product produced in accordance with the latter process is treated with a strengthening agent having an ionic charge of sign opposite to that which is conferred on the modified lignocellulosic material by the charge-conferring substituent.

8 Claims, No Drawings

PROCESS FOR INCREASING THE CHARGE ON A LIGNOCELLULOSIC MATERIAL

CROSS-REFERENCE TO RELATED APPLICATIONS

This application is a continuation of PCT/DK97/00052 filed Feb. 7, 1997 which claims priority under 35 U.S.C. 119 of Danish application Jan. 27, 1996 filed Feb. 8, 1996, the contents of which are fully incorporated herein by reference.

FIELD OF THE INVENTION

The present invention provides a process for modifying a lignocellulosic material, notably in fibre form (e.g. vegetable fibres originating from wood, flax, hemp, jute, bagasse and the like) so as to increase the binding capacity thereof with respect to binding of ionically charged strengthening agents, and thereby make possible the preparation of lignocellulose-based products (such as paper, paperboard, cardboard, linerboard, corrugated board, unbleached board and like products, sometimes referred to in the present specification simply as "paper products") of enhanced strength.

BACKGROUND AND BRIEF DESCRIPTION OF THE INVENTION

Lignocellulose-based products prepared from lignocellulosic starting materials, including products manufactured starting from vegetable fibre (e.g. wood fibre) prepared by mechanical (e.g. thermomechanical) pulping procedures, mechanical/-chemical pulping procedures (the latter often being denoted "semi-chemical" procedures) or chemical pulping procedures (such as kraft, sulfite or soda pulping), are indispensable everyday materials. Some of the most familiar types of such products include paper for writing or printing, cardboard and corrugated cardboard, as well as tissue and non-woven products.

Virtually all grades of paper, cardboard and the like are produced from aqueous pulp slurry. Typically, the pulp is suspended in water, mixed with various additives and then passed to equipment in which the paper, cardboard etc. is formed, pressed and dried. Irrespective of whether mechanically produced pulp (hereafter denoted "mechanical pulp"), semi-chemically produced pulp (hereafter denoted "semi-chemical pulp"), unbleached chemical pulp or pulp made from recycled fibres (i.e. pulp prepared from recycled paper, rags and the like) is employed, it is often necessary to add various strengthening agents to the pulp in order to obtain an end product having adequate strength properties. In the case of paper and board for use in packaging and the like, the tensile strength and tear strength under dry and wet conditions are of primary importance; moreover, notably in the case of certain grades of cardboard (e.g. so-called unbleached board for the manufacture of corrugated cardboard boxes for packaging, transport and the like), the compression strength of the material is often also an important factor.

In the field of lignocellulose-based products, considerable effort has been devoted in recent years to the development and application of strengthening/binding agents or systems which are more acceptable from an environmental and toxicity point of view than those "traditionally" used. Relevant patent literature in this respect includes the following:

EP 0 433 258 A1 discloses a procedure for the production of mechanical pulp from a fibrous product using a chemical and/or enzymatic treatment in which a "binding agent" is linked with the lignin in the fibrous product via the formation of radicals on the lignin part of the fibrous product. This document mentions "hydrocarbonates", such as cationic starch, and/or proteins as examples of suitable binding agents. As examples of suitable enzymes are mentioned laccase, lignin peroxidase and manganese peroxidase, and as examples of suitable chemical agents are mentioned hydrogen peroxide with ferro ions, chlorine dioxide, ozone, and mixtures thereof.

EP 0 565 109 A1 discloses a method for achieving binding of mechanically produced wood fragments via activation of the lignin in the middle lamella of the wood cells by incubation with phenol-oxidizing enzymes. The use of a separate binder is thus avoided by this method.

U.S. Pat. No. 4,432,921 describes a process for producing a binder for wood products from a phenolic compound having phenolic groups, and the process in question involves treating the phenolic compound with enzymes to activate and oxidatively polymerize the phenolic compound, thereby converting it into the binder. The only phenolic compounds which are specifically mentioned in this document, or employed in the working examples given therein, are lignin sulfonates, and a main purpose of the invention described in U.S. Pat. No. 4,432,921 is the economic exploitation of so-called "sulfite spent liquor", which is a liquid waste product produced in large quantities through the operation of the sulfite process for the production of chemical pulp, and which contains lignin sulfonates.

With respect to the use of lignin sulfonates—in particular in the form of sulfite spent liquor—as phenolic polymers in systems or processes for strengthening/binding wood products, the following comments are appropriate:

(i) lignin sulfonates available on a commercial scale are generally very impure and of very variable quality [see J. L. Philippou, *Journal of Wood Chemistry and Technology* 1(2) (1981) 199–227];

(ii) the very dark colour of spent sulfite liquor renders it unsuited as a source of lignin sulfonates for the production of, e.g., paper products (such as packaging paper, linerboard or unbleached board for cardboard boxes and the like) having acceptable colour properties.

In recent years, increasing use has been made in the paper industry of modified, polysaccharide-based substances, such as cationic starches (i.e. starches which have been modified by the introduction of cationic functionalities, normally quaternary ammonium groups). Cationic starches of the quaternary ammonium type are widely used in the industry as so-called "wet-end additives" for improving, inter alia, strength and drainage, and as binders in coatings. Other types of cationic agents which are commercially available for use as strengthening agents include cationic derivatives of guar gum [a poly(galactomannan) gum].

Reference may be made to a review by D. C. Smith in *TAPPI Proceedings* (1992 *Papermakers Conference*) pp. 393–404 for further information concerning these as well as other cationic and anionic polymeric strengthening agents ("strength additives").

By virtue of their ionic charge, such substances are able to bind relatively strongly, presumably via substantially electrostatic interaction, with oppositely charged functionalities [such as deprotonated carboxyl groups of uronic acid (e.g. glucuronic acid) moieties, or sulfonate groups originating from chemical modification of lignin] present in/on the fibres in lignocellulosic fibre pulp. However, the increase in strength achievable in this manner is determined by, inter alia, the "density" of appropriately charged groups on the surface of the fibres.

The present inventors have now surprisingly found that it is possible, by means of a straightforward procedure employing an enzyme which catalyzes the oxidation of phenolic groups (such as an oxidase classified under EC 1.10.3), in the presence of an appropriate oxidizing agent, to conjugate or graft (attach) to a lignocellulosic material (such as wood fibres or other vegetable fibres) phenolic substances (i.e. substances comprising at least a substituent containing a phenolic hydroxy group) having functionalities or substituents which in the conjugated (attached) form of the phenolic substance are, or under suitable conditions become, negatively or positively charged, respectively.

The phenolic substances in question are preferably substances of relatively low molecular weight; thus, in general, non-polymeric phenolic substances are preferred (vide infra). Phenolic polysaccharides (i.e. polysaccharides which are substituted with substituents containing a phenolic hydroxy group) are not within the scope of phenolic substances in the context of processes according to the present invention. Thus, for example, the phenolic polysaccharides employed in the context of the invention which is disclosed in applicant's International application No. PCT/DK95/00318 are not within the scope of phenolic substances employed in accordance with the present invention.

Owing to the resulting increased surface charge density, increased binding (as mentioned above) of an appropriate ionically charged strengthening agent to the lignocellulosic material may be achieved. Using the resulting product as starting material, the preparation of products, e.g. paper products, of greater strength than corresponding products prepared from lignocellulosic material with a lower content of strengthening agent may be achieved.

DETAILED DESCRIPTION OF THE INVENTION

The present invention thus provides a process for the production of a lignocellulosic material modified by conjugation thereto of a phenolic substance comprising a charge-conferring substituent which, in the conjugated form of the phenolic substance, is, or under suitable conditions (e.g. conditions resulting in protonation or deprotonation of the substituent in question) becomes, negatively or positively charged, respectively.

In the process of the invention, a lignocellulosic material and the phenolic substance in question are both subjected to an oxidation reaction brought about by the presence of an appropriate oxidizing agent and enzyme capable of catalyzing the oxidation of phenolic groups by that oxidizing agent. The oxidation products of the lignocellulosic material and the phenolic substance (which, as described below, are believed to be radical species) are then allowed to react with each other so as to form the modified lignocellulosic material in question.

As already mentioned above, phenolic substances employed in the process of the invention are subject to the proviso that they are not phenolic polysaccharides.

Enzymes of the type(s) employed in the process of the present invention, i.e. enzymes capable of catalyzing the oxidation of phenolic groups, are believed to lead to formation, in the presence of an appropriate oxidizing agent, of radicals in the aromatic moieties of phenolic substituents (such as, on the one hand, phenolic functionalities in phenolic substances as employed in the process of the invention, and, on the other hand, phenolic functionalities in the lignin part of a lignocellulosic substrate). Irrespective of its exact nature, the reaction in question may appropriately be termed "activation".

With reference to the above, the order of mixing/contacting the four components, i.e. the lignocellulosic material, the phenolic substance, the enzyme and the oxidizing agent, is not critical as long as the process set-up ensures that the "activated" lignocellulosic material and the "activated" phenolic substance are brought together in a way that enables them to react in the desired manner. It is thus possible to perform the process of the invention in one or more steps or stages, for example as follows:

(i) The lignocellulosic material and the phenolic substance, respectively (i.e. separately), may be mixed with (or otherwise brought into contact with) the enzyme and the oxidizing agent and allowed to react (i.e to become "activated"), after which the respective "activated" products are brought together and allowed to react mutually;

(ii) the lignocellulosic material may be mixed with (or otherwise contacted with) the enzyme and the oxidizing agent before being mixed with the phenolic substance, i.e. "activation" of the lignocellulosic material is initiated (or possibly completed) before initiating "activation" of the phenolic substance;

(iii) the phenolic substance may be mixed with (or otherwise contacted with) the enzyme and the oxidizing agent before being mixed with the lignocellulosic material, i.e. "activation" of the phenolic substance is initiated (or possibly completed) before initiating "activation" of the lignocellulosic material;

(iv) the lignocellulosic material, the phenolic substance, the enzyme and the oxidizing agent may be mixed together (or otherwise brought into contact with each other) substantially simultaneously, i.e. "activation" of the lignocellulosic material and the phenolic substance is initiated substantially simultaneously;

By way of illustration, a working example herein (vide infra) makes use of a procedure as in (ii), above.

The Reaction Medium

In general, a reaction medium in which a process of the invention (or a step or stage thereof) as disclosed above is performed will be a predominantly aqueous medium. Where appropriate, the medium may—in addition to the above-mentioned components—contain, for example, a pH-adjusting agent (acid, base and/or buffering agent), one or more water-miscible organic solvents (e.g. to assist in solubilization of the phenolic substance in question) and/or other appropriate adjuvants.

Lignocellulosic Material

The term "lignocellulosic material" as employed herein is intended to embrace naturally occurring, synthetic and semi-synthetic materials having (i) a cellulosic or hemicellulosic part and (ii) a lignin or lignin-like part. Thus, for example, a cellulosic material such as cotton (which itself contains little or no lignin) which has been chemically modified so as to introduce a lignin-like (e.g. phenolic) component is to be understood as being a lignocellulosic material in the context of the invention.

The lignocellulosic starting material employed in the process of the invention can be in any appropriate form, e.g. in the form of vegetable fibre pulp (containing fibres from wood, flax, hemp, bagasse, jute or the like), depending on the type of product to be manufactured. Fibre pulp suitable for use in the process of the invention may be produced by a variety of conventional pulping procedures, such as mechanical (e.g. thermomechanical) pulping procedures, mechanical/chemical pulping procedures (the latter often being denoted "semi-chemical" procedures) or chemical pulping procedures (such as kraft, sulfite or soda pulping).

Pulp produced by a chemical pulping procedure may be bleached or unbleached.

It will normally be appropriate to employ the lignocellulosic material in question in an amount corresponding to a weight percentage of dry lignocellulosic material [dry substance (DS)] in the medium in the range of 0.01–90%, such as 0.1–40% w/w.

Phenolic Substances

As indicated above, the phenolic substance employed in the process of the present invention is a substance containing a substituent having an hydroxy group attached to an aromatic ring, and is a substance other than a phenolic polysaccharide.

In addition to having one or more hydroxy substituents present in an aromatic ring, a phenolic substance employed in the context of the invention may optionally further be substituted in the same aromatic ring with one or more other substituents, e.g. one or more lower alkoxy groups (such as methoxy, ethoxy, 1-propoxy or 2-propoxy), and/or one or more lower alkyl groups (such as methyl, ethyl, 1-propyl or 2-propyl).

In the case of phenolic substances which when conjugated or grafted to the lignocellulosic material are to confer a negative charge, preferred phenolic substances include phenolic carboxylic acids and derivatives thereof wherein the carboxyl group is esterified (e.g. with a lower alkyl group) or is in the salt form (—$COO^-$). In performing the process of the invention it will often be appropriate to employ a relatively water-soluble salt form [such as the sodium salt or another alkali metal salt (produced, for example, in situ by dissolving the acid in an aqueous solution of the appropriate base, e.g. NaOH)]. Examples of relevant phenolic carboxylic acids include phenolic derivatives of benzoic acid, e.g. 2-, 3- or 4-hydroxybenzoic acid (particularly 4-hydroxybenzoic acid), vanillic acid (i.e. 4-hydroxy-3-methoxybenzoic acid) and syringic acid (i.e. 4-hydroxy-3,5-dimethoxybenzoic acid).

Further examples of suitable phenolic carboxylic acids include phenolic derivatives of cinnamic acid, such as the coumaric acids (particularly p-coumaric acid, i.e. 4-hydroxycinnamic acid), caffeic acid (3,4-dihydroxycinnamic acid), sinapinic acid (3,5-dimethoxy-4-hydroxycinnamic acid; also known as sinapic acid) and ferulic acid (4-hydroxy-3-methoxycinnamic acid).

In the case of cinnamic acid derivatives such as those specifically mentioned above (all of which are commercially available), it does not appear to have been established clearly whether they comprise one or both of the two possible geometric isomeric forms (cis and trans, respectively), or both; it appears likely, however, that the trans form is generally predominant.

Among other phenolic substances of interest in the context of conferring a negative charge to the lignocellulosic material include phenolic sulfonic acids and corresponding sulfonate salts.

The amount of phenolic substance (e.g. a phenolic carboxylic acid) employed in the process of the invention will generally be in the range of 0.01–20 weight per cent (% w/w), typically 0.01–10% w/w, based on the weight of lignocellulosic material (calculated as dry lignocellulosic material), and amounts in the range of about 0.02–6% w/w (calculated in this manner) will often be very suitable.

Enzymes

Enzyme classification numbers (EC numbers) referred to in the present specification with claims are in accordance with the *Recommendations* (1992) *of the Nomenclature Committee of the International Union of Biochemistry and Molecular Biology,* Academic Press Inc., 1992.

In principle, any type of enzyme capable of catalyzing oxidation of phenolic groups may be employed in the process of the invention. Preferred enzymes are, however, oxidases, particularly oxidases classified under EC 1.10.3 [e.g. laccases (EC 1.10.3.2)] and peroxidases (EC 1.11.1.7), particularly peroxidases classified under EC 1.11.1.7. In some cases it may be appropriate to employ two or more different enzymes in the process of the invention.

Oxidases

As mentioned above, preferred oxidases in the context of the present invention are oxidases classified under EC 1.10.3, which are oxidases capable of catalyzing oxidation of phenolic groups. Oxidases are enzymes employing molecular oxygen as acceptor (i.e. enzymes catalyzing oxidation reactions in which molecular oxygen functions as oxidizing agent).

As also indicated above, laccases (EC 1.10.3.2) are very suitable oxidases in the context of the invention. Examples of other potentially useful, phenol-oxidizing oxidases in the context of the invention include the catechol oxidases (EC 1.10.3.1).

Laccases are obtainable from a variety of microbial sources, notably bacteria and fungi (including filamentous fungi and yeasts), and suitable examples of laccases are to found among those obtainable from fungi, including laccases obtainable from strains of Aspergillus, Neurospora (e.g. *N. crassa*), Podospora, Botrytis, Collybia, Fomes, Lentinus, Pleurotus, Trametes [some species/strains of which are known by various names and/or have previously been classified within other genera; e.g. *Trametes villosa*=*T. pinsitus*=*Polyporus pinsitis* (also known as *P. pinsitus* or *P. villosus*)=*Coriolus pinsitus*], Polyporus, Rhizoctonia (e.g. *R. solani*), Coprinus (e.g. *C. plicatilis*), Psatyrella, Myceliophthora (e.g. *M. thermophila*), Schytalidium, Phlebia (e.g. *P. radita*; see WO 92/01046), or Coriolus (e.g. *C.hirsutus*;

see JP 2-238885).

Preferred laccases in the context of the invention include laccase obtainable from *Trametes villosa* and laccase obtainable from *Myceliophthora thermophila.*

For *Trametes villosa* laccase, the amount of laccase employed in the process of the invention should generally be in the range of 0.02–2000 LACU per g (dry weight) of lignocellulosic material, preferably 0.05–100 LACU/g of lignocellulosic material, and will typically be in the range of 0.1–100 LACU/g, such as about 1 LACU/g, of lignocellulosic material (LACU is the unit of laccase activity as defined below).

Determination of Laccase Activity (LACU)

Laccase activity as defined herein is determined on the basis of spectrophotometric measurements of the oxidation of syringaldazin under aerobic conditions. The intensity of the violet colour produced in the oxidation reaction is measured at 530 nm.

The analytical conditions are: 19 $\mu$M syringaldazin, 23.2 mM acetate buffer, pH 5.5, 30° C., reaction time 1 minute, shaking. 1 laccase unit (LACU) is the amount of enzyme that catalyses the conversion of 1 $\mu$M of syringaldazin per minute under these conditions.

For laccases in general, the amount of laccase employed in the process of the invention will generally be in the range of 0.0001–20 mg of laccase (calculated as pure enzyme protein) per gram (dry weight) of lignocellulosic material, such as 0.0001–10 mg/g, more usually 0.001–1 mg/g, and will typically be in the range of 0.01–1 mg of laccase per gram of lignocellulosic material.

Peroxidases

Peroxidase enzymes (EC 1.11.1) employed in the process of the invention are preferably peroxidases obtainable from plants (e.g. horseradish peroxidase or soy bean peroxidase) or from microorganisms, such as fungi or bacteria. In this respect, some preferred fungi include strains belonging to the subdivision Deuteromycotina, class Hyphomycetes, e.g. Fusarium, Humicola, Tricoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes.*

Other preferred fungi include strains belonging to the subdivision Basidiomycotina, class Basidiomycetes, e.g. Coprinus, Phanerochaete, Coriolus or Trametes, in particular *Coprinus cinereus f. microsporus* (IFO 8371), *Coprinus macrorhizus, Phanerochaete chrysosporium* (e.g. NA-12) or *Trametes versicolor* (e.g. PR4 28-A).

Further preferred fungi include strains belonging to the sub-division Zygomycotina, class Mycoraceae, e.g. Rhizopus or Mucor, in particular *Mucor hiemalis.*

Some preferred bacteria include strains of the order Actino-mycetales, e.g. *Streptomyces spheroides* (ATTC 23965), *Streptomyces thermoviolaceus* (IFO 12382) or *Streptoverticillum verticillium* ssp. verticillium.

Other preferred bacteria include *Bacillus pumilus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Further preferred bacteria include strains belonging to Myxococcus, e.g. *M. virescens.*

Other potential sources of useful particular peroxidases are listed in B. C. Saunders et al., *Peroxidase*, London 1964, pp. 41–43.

As already indicated, preferred peroxidases in the context of the invention include peroxidases classified under EC 1.11.1.7.

When employing a peroxidase in a process according to the invention, an amount thereof in the range of 0.00001–1 mg of peroxidase (calculated as pure enzyme protein) per gram (dry weight) of lignocellulosic material, such as 0.00001–0.1 mg/g, will generally be appropriate. The amount employed will often be in the range of 0.0001–0.1 mg/g, e.g. in the range of 0.0001–0.01 mg of peroxidase per gram of lignocellulosic material.

Oxidizinq Agents

The enzyme(s) and oxidizing agent(s) used in the process of the invention should clearly be matched to one another, and it is clearly preferable that the oxidizing agent(s) in question participate(s) only in the oxidative reaction involved in the binding process, and does/do not otherwise have any adverse effect on the substances/materials involved in the process.

Oxidases of the types in question, e.g. laccases, are, among other reasons, well suited in the context of the invention since—as mentioned above—they catalyze oxidation by molecular oxygen. Thus, reactions taking place in vessels open to the atmosphere and involving an oxidase as enzyme will be able to utilize atmospheric oxygen as oxidant; it may, however, be desirable to forcibly aerate the reaction medium with air or another oxygen-containing gas (e.g. oxygen-enriched air or, if appropriate, substantially pure oxygen) during the reaction to ensure an adequate supply of oxygen.

In the case of peroxidases, hydrogen peroxide is a preferred peroxide (oxidizing agent) in the context of the invention and is normally employed in a concentration (in the reaction medium) in the range of 0.01–500 mM, typically in the range of 0.01–100 mM. For many peroxidases, a suitable concentration range will be from 0.05 to 10 mM, e.g. from 0.05 to 5 mM.

Temperature in the Reaction Medium

The temperature of the reaction mixture in the process of the invention will depend, inter alia, on the characteristics of the enzyme(s) employed and on the manner in which the process is carried out.

Thus, if the process is performed as a "one-stage" process in which lignocellulosic material, phenolic substance, enzyme and oxidizing agent are all present together essentially throughout the process, it will normally be desirable to limit the upper temperature employed to a temperature which does not cause adversely rapid deactivation of, in particular, the enzyme employed. In such cases, the temperature will normally not exceed about 80° C., and will suitably be in the range of 20–70° C.

However, as already mentioned, it is also possible to carry out the process of the invention in more than one stage, e.g. by first "activating" the lignocellulosic material and the phenolic substance, respectively, using enzyme and oxidizing agent at a temperature as mentioned above (i.e. a temperature which is typically in the range of 20–80° C., such as 20–70° C.), and then combining the activated lignocellulosic material and the activated phenolic substance and—if appropriate—raising the temperature, e.g. to a temperature in the range of 70–170° C. This may require pressurization of the reaction vessel/system to prevent boiling of the reaction medium.

As illustrated by a working example herein (vide infra), the reactions involved in a typical process of the invention may take place satisfactorily at a temperature in the vicinity of ambient temperature (which is often about 25° C.), such as a temperature of about 30° C.

pH in the Reaction Medium

Depending, inter alia, on the characteristics of the enzyme (s) employed, the pH in the reaction medium in which the process of the invention takes place will generally be in the range of 3–10, preferably in the range of 4–9, and often in the range of 4–8.

Reaction Time

The reaction times employed in performing a process of the invention will depend, inter alia, on the temperature(s) employed, and the nature of the lignocellulosic material and the phenolic substance employed; it is thus difficult to give general guidelines in this respect. As illustrated by a working example herein, the use of a temperature of about 30° C. results in satisfactory reaction being achieved within a period of less than 1 hour.

The present invention also relates to a modified lignocellulosic material obtained or obtainable by a process according to the invention as disclosed herein.

A further aspect of the invention relates to a process for the manufacture of a strengthened lignocellulose-based product (e.g. a paper product of one of the types mentioned earlier), wherein a modified lignocellulosic material according to the invention is treated with an strengthening agent having an ionic charge of sign opposite to that which is conferred on the modified lignocellulosic material by the charge-conferring substituent referred to previously (vide supra).

Cationic strengthening agents appropriate for use in the context of the invention include cationic polysaccharides (e.g. cationic starches, cationic derivatives of modified starches, and cationic derivatives of guar gum), as well as cationic derivatives of synthetic or semi-synthetic polymers (such as cationic derivatives of polyacrylates).

A thus-treated, modified lignocellulosic material may (a) be isolated (as an intermediate product) and subsequently used as a starting intermediate for the preparation of a strengthened lignocellulose-based product of interest; or (b) subjected directly (i.e. without isolation) to those further process steps which are appropriate for the manufacture of the final strengthened product.

As already indicated to some extent above, a process of the invention as described above is well suited to the production of a variety of types of lignocellulose-based products, such as various paper products [for example writing and printing paper, paper bags, packaging paper (e.g. "brown paper" and the like)], paperboard products (such as cardboard, linerboard and the like), tissue and non-woven products, and a variety of other speciality products (e.g. egg boxes, egg trays and other types of packaging materials).

Intermediate products and final (strengthened) lignocellulose-based products of the above-mentioned types in question are both within the scope of the present invention.

It should be noted here that in addition to being able to oxidize ("activate"; apparently radicalize) phenolic groups, the combinations of enzymes (oxidoreductases) and oxidizing agents employed in the context of the invention, e.g. laccases and oxygen, are capable of causing similar reactions with various non-phenolic species; these include, but are not limited to, substances such as aromatic amines (substances having an amino group attached to an aromatic ring, e.g. o-, m- or p-phenylene-diamine).

Thus, instead of using a phenolic substance in a process of the invention as disclosed herein, it is equally possible to employ another type of substance (e.g. of the aromatic amine type) which is correspondingly capable of undergoing oxidative "activation" by an enzyme/oxidizing agent combination as employed herein. Such variants of the process are within the scope of the present invention.

Likewise, instead of using a lignocellulosic material (as defined above) in a process of the invention, it is equally possible to employ another type of material (notably fibre material) having an non-ligninaceous (non-phenolic) "lactivatable" functionality (e.g. of the aromatic amine type). Moreover, the material need not comprise a cellulosic or hemicellulosic component, but may instead comprise some other component derived from another type of naturally occurring or synthetic polymer or copolymer.

The present invention embraces all such variants of the process(es) of the invention as described above, as well as corresponding intermediate and final products obtained or obtainable thereby.

MATERITALS AND METHODS

Among materials employed in the working examples described below, the following were obtained from the indicated sources:

*Trametes villosa* laccase; liquid preparation of activity 200 LACU/g, produced by Novo Nordisk A/S, Bagsvaerd, Denmark;

beech wood mechanical pulp, obtained from a Danish producer; and ferulic acid, obtained from Sigma (catalogue No. F3500).

A solution containing the sodium salt of ferulic acid for use in the example given below was prepared as follows: 2.0 g of ferulic acid was suspended in 100 ml of de-ionized water. 4M aqueous NaOH was added slowly until all the ferulic acid had dissolved, at which point the pH of the solution was about 7.5.

EXAMPLE 1

Grafting of Ferulic Acid Onto Beech Wood Pulp

A 20 g portion of beech wood pulp was suspended in 1000 ml of deionized water. The pH of the suspension was adjusted to 4.5 by addition of 4M sulfuric acid, and was maintained thereafter between 4.5 and 6 throughout the subsequent procedure, described below, by addition of aqueous 4M sodium hydroxide or aqueous 4M sulfuric acid.

Throughout the following, the suspension was stirred, aerated by bubbling with air, and maintained at a temperature of 30° C. by immersion of the vessel containing the suspension in a thermostatted water bath:

At time t=0, laccase (3 LACU/g of pulp dry matter) was added to the suspension. After 15 minutes, addition of "ferulic acid" solution (vide supra) was begun, and the solution was added at a constant rate during the next 15 minutes. The total amount of solution added during the 15 minute period was equivalent to an amount of ferulic acid corresponding to 2% w/w of the pulp dry matter.

After a further 15 minutes, the reaction mixture was filtered by suction on a Büchner funnel. The solid material on the filter (modified beech pulp) was resuspended in water to give a concentration of suspended solid of ca. 1% w/w, and the suspension was suction-filtered as before.

For comparison purposes, three further experiments (two controls and one reference) were performed following the same procedure as above but with a) omission of laccase, b) omission of "ferulic acid" and c) (reference) omission of laccase and "ferulic acid", respectively. Missing liquid volume was compensated for, where appropriate, by addition of de-ionized water.

The surface charge of the four pulp samples was determined by polyelectrolyte adsorption experiments with Poly-DADMAAC (a cationic polymer) according to the procedure described by L. Wågberg et al., *Nordic Pulp Pap. Res. J.* 4(2) (1989) 71.

The results of the surface charge measurements are shown in the following table:

| Treatment of pulp | Surface charge (μequiv./g) |
|---|---|
| Reference | 3.7 |
| Ferulic acid only | 3.4 |
| Laccase only | 3.8 |
| Invention (laccase + ferulic acid) | 5.6 |

The above results demonstrate that it is possible to increase the surface charge of lignocellulosic material (in this case wood fibre pulp) significantly by grafting a phenolic acid (in this case ferulic acid) onto the material by a process according to the invention.

As already mentioned, such an increase in surface charge will make it possible to incorporate an increased amount of an appropriately charged strengthening agent [e.g. a cationic starch in the case of a charge-conferring substituent which gives rise to a negative charge, such as carboxyl (—COOH→—$COO^-$)] into a lignocellulose-based product (e.g. a paper product) during preparation of such a product starting from a modified lignocellulosic material according to the invention, whereby increased strength of the lignocellulose-based product (e.g. increased tensile strength, tear strength and/or compression strength in the case of a paper product) may be achieved.

What is claimed is:

1. A process for altering the surface charge of a lignocellulosic material, said process comprising (i) reacting a lignocellulosic fibre material with an oxidizing agent in the presence of an enzyme capable of catalyzing the oxidation of phenolic groups by said oxidizing agent, (ii) reacting a phenolic carboxylic acid or a salt or an ester thereof with an oxidizing agent in the presence of an enzyme capable of catalyzing the oxidation of phenolic groups by said oxidizing agent, wherein said phenolic carboxylic acid is exogenous to said lignocellulosic material; and (iii) reacting the products of steps (i) and (ii) together, under conditions that result in an increase in the negative charge of said lignocellulosic material.

2. The process according to claim 1, wherein said lignocellulosic material comprises fiber originating from a vegetable source selected from the group consisting of wood, flax, cotton, hemp, jute and bagasse.

3. The process according to claim 1, wherein said enzyme is selected from the group consisting of oxidases classified under EC 1.10.3 and peroxidases classified under EC 1.11.1.

4. The process according to claim 3, wherein said oxidase is a laccase classified under EC 1.10.3.2 and said oxidizing agent is oxygen.

5. The process according to claim 4, wherein said laccase is obtainable from a fungus selected from the group consisting of: Myceliophthora species and Trametes species.

6. The process according to claim 5, wherein said Myceliopthora species is *Myceliopthora thermophila*.

7. The process according to claim 5, wherein said Trametes species is *Trametes villosa*.

8. The process according to claim 1, wherein said enzyme is a peroxidase and said oxidizing agent is hydrogen peroxide.

* * * * *